United States Patent [19]

Spanio

[11] Patent Number: 5,075,517

[45] Date of Patent: Dec. 24, 1991

[54] CAM OPERATED ELECTRICAL CHANGEOVER SWITCH OR CIRCUIT BREAKER TAPPET-TYPE CONTACT STRUCTURE

[75] Inventor: Marino Spanio, Cusano Milanino, Italy

[73] Assignee: Bremas S.p.A., Italy

[21] Appl. No.: 498,956

[22] Filed: Mar. 26, 1990

[51] Int. Cl.[5] ..... H01H 1/12; H01H 15/02

[52] U.S. Cl. ..... 200/16 A; 200/242

[58] Field of Search ..... 200/16 A, 240, 241, 200/242, 243, 246, 248, 574, 5 R, 307, 4, 17 R, 18, 30 R, 31 R

[56] References Cited

U.S. PATENT DOCUMENTS

| | | | |
|---|---|---|---|
| 3,928,740 | 12/1975 | Alsch | 200/574 |
| 4,277,662 | 7/1981 | Lewandowski | 200/242 |
| 4,650,935 | 3/1987 | Ootsuka et al. | 200/16 A |
| 4,839,475 | 6/1989 | Wilkinson et al. | 200/16 A X |
| 4,861,949 | 8/1989 | Bortolloni et al. | 200/5 R |

*Primary Examiner*—J. R. Scott

*Attorney, Agent, or Firm*—Steinberg & Raskin

[57] ABSTRACT

A tappet, in particular for cooperating with camshafts in electrical changeover switches, circuit breakers or the like, comprises a body provided with a cavity opening into two opposing faces of the body and containing, mobile against a spring, a generally flat contact element the opposing free ends of which project from the cavity and from the body so as to cooperate with fixed contacts generally arranged to the sides of the body and rigid with the casing of the changeover switch or the like. The movable contact is subjected to the action of an element or slider movable within the cavity and arranged to cooperate with the cams of a camshaft. According to the invention, the slider comprises projecting elements slidable in a guided manner in guide slots or tracks provided in the body of the tappet during its movement within the recess of the latter, with consequent displacement of the movable contact from an inoperative position to a working position in which it cooperates with the fixed contacts of the changeover switch or the like, the movable contact rocking relative to the slider by rotating about an axis on being displaced from its working position.

7 Claims, 2 Drawing Sheets

CAM OPERATED ELECTRICAL CHANGEOVER SWITCH OR CIRCUIT BREAKER TAPPET-TYPE CONTACT STRUCTURE

BACKGROUND OF THE INVENTION

This invention relates to a tappet, in particular for cooperating with camshafts in electrical changeover switches, or circuit breakers, comprising a body provided with a cavity opening into two opposing faces of the body and containing, movable against a spring, a generally flat contact element, the opposing free ends of which project from cavity and from body so as to cooperate with fixed contacts generally arranged at the sides of the body and rigid with the casing of the changeover switch. The movable contact is subjected to the action of an element or slider movable within the cavity and arranged to cooperate with the cams of a usual camshaft.

Tappets of the aforesaid type have been known for some time and have been used for a number of years in electrical components.

However, known tappets generally comprise a number of components which to make it difficult to assemble, particularly in view of their small dimensions.

Their construction is consequently lengthy and laborious, with resultant high cost of the finished electrical component such as a circuit breaker or changeover switch.

A further drawback of tappets of the state of the art is that those movable contacts which cooperate with the fixed contacts of the changeover switch or the like move relative to the fixed contacts, generally along directions perpendicular thereto, i.e. when the movable contacts separate from the fixed contacts the movable contacts move substantially perpendicular to the fixed contacts.

Although this ensures good electrical contact between the contacts, it has various drawbacks, the most important of which is that it does not allow cleaning in particular of the fixed contacts but also of the movable contacts, cleaning is necessary in order to remove the scum, oxides or the like which inevitably form on the contacts during the use of the changeover switch or circuit breaker.

SUMMARY OF THE INVENTION

An object of the present invention is therefore to provide a tappet of the aforesaid type which has a lower construction time and cost than known tappets.

A further object of the invention is to provide a tappet by which the removal of oxides, scum or the like from both the fixed and movable contacts takes place during use.

A further object is consequently to provide a tappet by which optimum connection is obtained between the fixed and movable contacts and which provides reliable operation.

These and further objects which will be apparent to the expert of the art are attained by a tappet of the aforesaid type characterised in that the slider comprises projecting elements slidable in a guided manner in guide slots or tracks provided in the body of the tappet during movement of the slider within the recess of the tappet body, with consequent displacement of the movable contact from an inoperative position to a working position in which it cooperates with the fixed contacts of the changeover switch or circuit breaker. The mobile contact rocks relative to the slider by rotating about an axis on being displaced from its working position.

DESCRIPTION OF THE DRAWINGS

The present invention will be more apparent from the accompanying drawing which is provided by way of non-limiting example only and in which.

DETAILED DESCRIPTION

Figure 1:
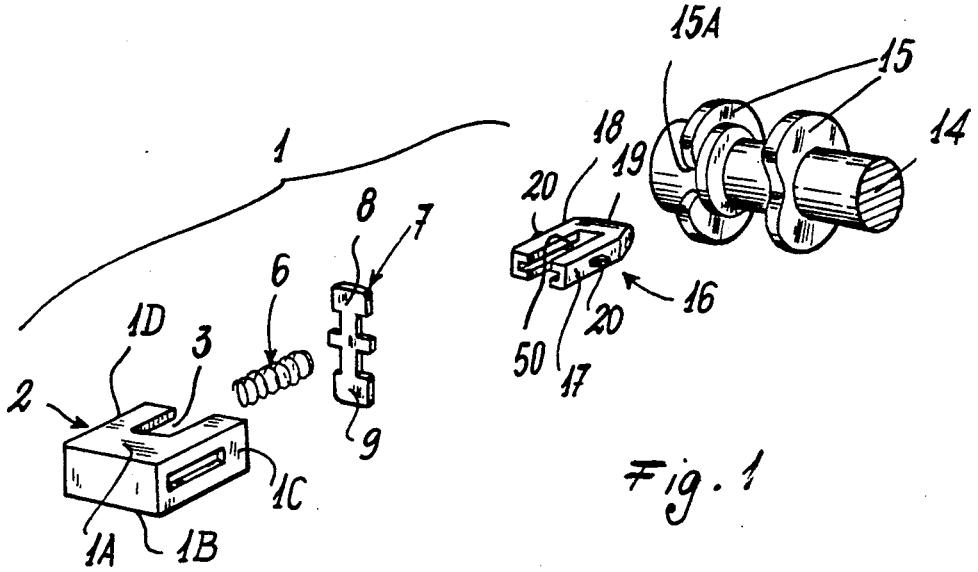
FIG. 1 is an exploded perspective view of a tappet constructed in accordance with the invention for cooperating with a camshaft, which is only partially represented.
Figure 2:
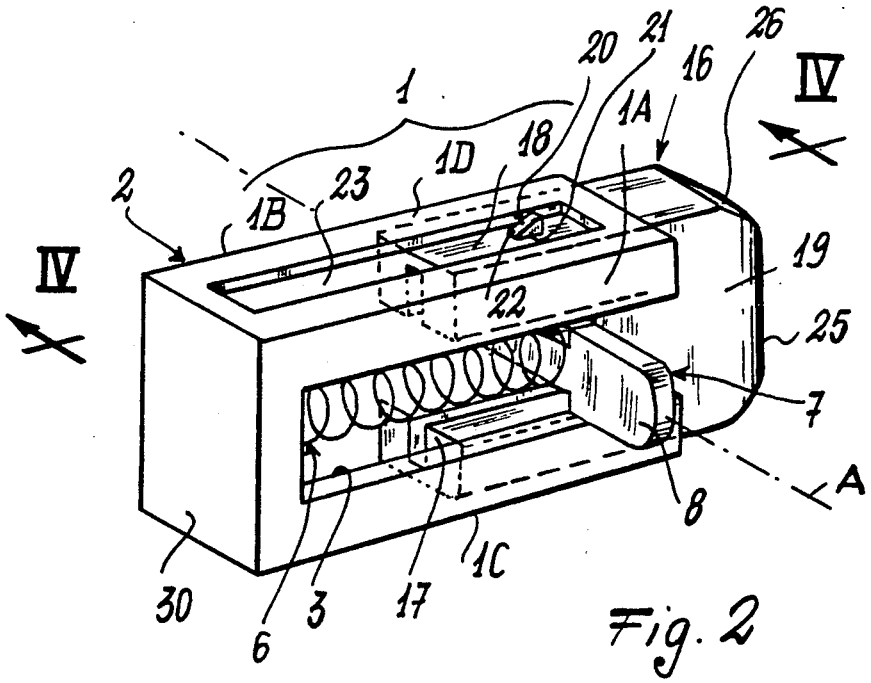
FIG. 2 is a perspective view of a tappet according to the invention in its non-operating position.

With reference to the figures, the tappet is indicated overall by 1 and comprises a body 2, of U-shape, provided with a cavity 3 which opens into two opposing faces 1A and 1B of said body 2.

In the cavity 3 there is arranged a usual compression spring 6 against which a usual contact element 7 or more simply movable contact, 7 moves within cavity 3.

Said mobile contact 7 is substantially of flat elongate shape with its opposing free ends 8, 9 arranged to cooperate with fixed contacts 10 and 11 (see FIG. 3) rigid with the casing 12 of a changeover switch 13. A usual camshaft 14 comprising cams 15, with which the tappets 1 cooperate, is arranged in casing 12 and supported in known manner.

A mobile element or slider 16 is associated with the body 2 of each tappet 1. In the example illustrated and described herein, the slider is substantially of U shape, comprising sides 17 and 18 joined together by a transverse element or headpiece 19, said slider headpiece 19 being arranged to cooperate with a cam 15 associated with the camshaft 14 and provide with a usual recess 15A.

According to the invention, with the sides 17 and 18 there are associated projections 20, the region 21 in which the sides 17 and 18 join to the sides 17 and 18 being of larger section than the free end 22, i.e. each projection 20 has a cross-section in the form of a right angled triangle which tapers towards the end 22 and each projection has its oblique the facing away from said headpiece 19.

The projections 20 are arranged to slide in slots 23 provided in faces 1C and 1D of the body 2 of the tappet and acting as guide racks for the movement of the slider 16. The projection 20 cooperate with the movable contact 7 which is disposed in a seat 50 in the slider defined by its sides 17 and 18 and is urged by the spring 6 to rest against an inner part 24 of the slider headpiece 19. The outer end 25 of the slides is arranged to cooperate with the cams 15 and comprises inclined lateral ends 26 to facilitate the introduction of the headpiece 19 into the recess 15A of the respective cam 15 and its withdrawal from the same when the headpiece is not in correspondence with the seat.

Figure 3:
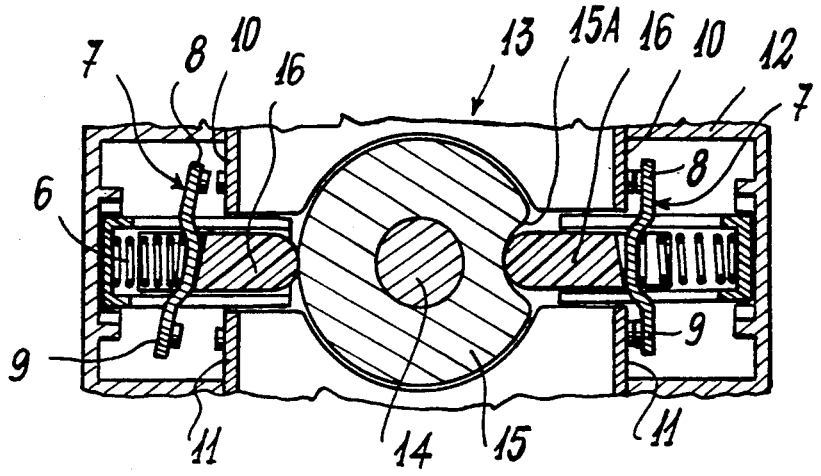
FIG. 3 is a partial cross-section through an electrical changeover switch using tappets according to the invention.
Figure 4:
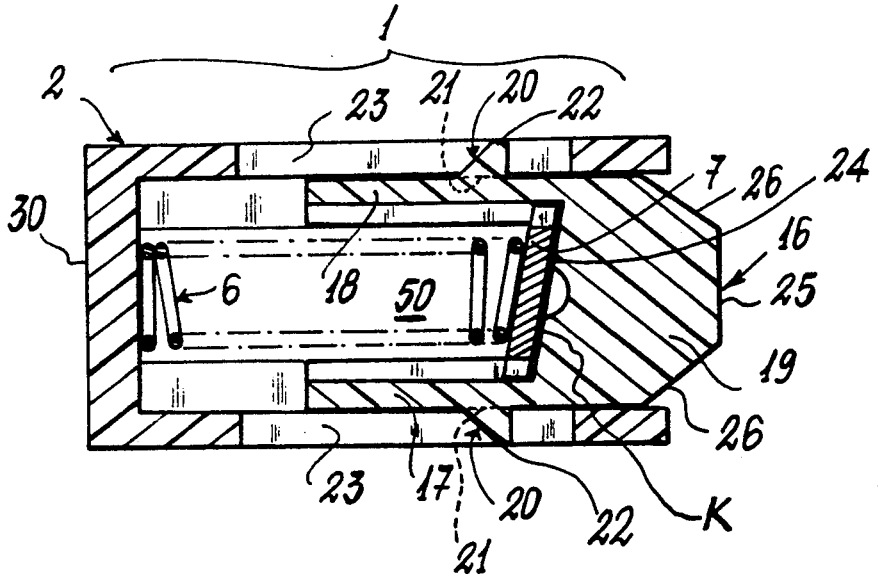
FIG. 4 is a section on line IV—IV of FIG. 2.

The inner part 24 of the slider headpiece 19 is inclined as shown in FIG. 4, so that when in its inoperative position as shown in FIG. 4 and assumed by the movable contact 7 shown to the left in FIG. 3, the movable contact 7 is slightly inclined from a position parallel to the base 30 of the body 2 of the tappet 1 (or "vertical" position with reference to the figures).

The tappet 1 is mounted easily and rapidly.

To achieve this, the spring 6 and contact 7 are arranged in the cavity of the body such that the ends 8 and 9 of the contact project from the cavity.

The slider 16 is then associated with the body 2. This is facilitated by the elasticity of the material of construction of these elements, generally plastics, and their U shape.

Specifically, the slider 16 is placed at the entrance to the body 2 such that the sides 17 and 18 of the slider correspond with the faces 1C and 1D of the body.

The slider 16 is then pushed so that it penetrates into the body 2. Because of the tapered shape of the projections 20 on the slider 16, this insertion is simple and fast, aided also by the shape of the slider 16 and body 2 and their constituent material.

In this respect, during the introduction, the sides 17 and 18 of the slider 16 approach each other whereas the faces 1C and 1D of the body 2 diverge. This continues until the projections 20 on the slider 16 reach the slots 23. At this point the projections 20 snap-penetrate into the slots 23 and the body 2 returns to its original shape to retain the slider 16.

As stated, during use the mobile contact 7 in the inoperative position is inclined to the "vertical", with reference for example to FIG. 3 but reaches "vertical" when in its working position as represented by the movable contact 7 on the right of the changeover switch 13 shown in FIG. 3.

This is due to the action of the cams 15 on each tappet head 16 and the subsequent movement of the tappet head 16.

In such a situation, each contact 7 rocks relative to the corresponding headpiece 19 by rotating relative to the movable contact 7 about an axis A passing through a particular line of contact between the inner part 24 of the slider headpiece and the movable contact itself, note the line passing through the point K in FIG. 4. By this means, each time a cam 15 urges the slider 16 to re-enter the body 2, the mobile contact 7, arranged "vertically" in FIG. 3, separates from the fixed contact by rotating about the axis A. A rubbing action therefore results between the contacts, to remove from them, and particularly from the fixed contact) any scum, impurities or oxides which have deposited on them during the use of the changeover switch.

The dimensions of the end 25 of the slider headpiece 19 can vary according to the application of the tappet.

A tappet constructed in accordance with the invention is simple and rapid to assemble, is of short construction time, is reliable in use and allows cleaning of the fixed and movable contacts.

What I claim is:

1. A tappet, in particular for cooperating with camshafts in electrical changeover switches or circuit breakers, comprising a body provided with a cavity opening into two opposing faces of said body, a spring arranged in said cavity of said body, a generally flat movable contact element arranged within said cavity and contacting said spring, said movable contact having opposing free ends which project from said cavity and from said body, said opposing free ends adapted to cooperate with fixed contacts which are rigid with a casing of a changeover switch or circuit breaker when said changeover switch or circuit breaker is arranged to the sides of said body, a slider movable within said cavity and arranged to cooperate with the cams of a camshaft arranged in said casing of said changeover switch or circuit breaker, said slider comprising projecting elements slidable in a guide manner in guide slots provided in said body of the tappet during movement of said slider within said body, said slider further comprising a head piece having an inclined inner wall, said movable contact being urged by said spring against said inner wall such that movement of said slider causes displacement of the movable contact from an inoperative position to a working position in which it can cooperate with the fixed contacts of the changeover switch or circuit breaker, said movable contact remaining in an inclined position with respect to a vertical axis when said movable contact is in said inoperative position and said movable contact being in a non-inclined position parallel to said vertical axis when in said working position, said movable contact rocking relative to said slider by rotating about an axis passing through a line of contact between said inner wall and said movable contact when said movable contact is displaced from its working position.

2. A tappet as claimed in claim 1, characterised in that the projecting elements project from sides of the slider, said elements comprising a wide portion where they join to said sides and tapering towards their free end.

3. A tappet as claimed in claim 2, characterized in that the projecting elements of said slider have a cross-section in the form of a substantially right angled triangle which tapers toward an end thereof, an oblique side facing away from said headpiece.

4. A tappet as claimed in claim 1, characterised in that the body of the tappet and the slider are substantially of U shape.

5. A tappet as claimed in claim 1 characterised in that the body of the tappet and the slider are formed of elastically deformable material.

6. A tappet as claimed in claim 1, characterised in that the slider comprises, for containing the mobile contact a seat defined by cursor sides and a headpiece.

7. A tappet as claimed in claim 6, characterized in that passage from the non-inclined to the inclined position occurs as a result of the movement of the slider towards the interior of the cavity in the body of the tappet when the slider headpiece cooperates with a cam of the camshaft.

* * * * *